US006588721B1

(12) United States Patent
Rischmueller

(10) Patent No.: US 6,588,721 B1
(45) Date of Patent: Jul. 8, 2003

(54) SUSPENDING DEVICE FOR A PLANT CONTAINER

(76) Inventor: Guy Robert Rischmueller, P.O. Box 1157, Glenelg South, South Australia 5045 (AU)

( * ) Notice: Subject to any disclaimer, the term of this patent is extended or adjusted under 35 U.S.C. 154(b) by 0 days.

(21) Appl. No.: 09/600,303

(22) PCT Filed: Jan. 11, 1999

(86) PCT No.: PCT/AU99/00038

§ 371 (c)(1),
(2), (4) Date: Feb. 9, 2001

(87) PCT Pub. No.: WO99/34713

PCT Pub. Date: Jul. 15, 1999

(30) Foreign Application Priority Data

Jan. 12, 1998 (AU) ..... PP1272

(51) Int. Cl.[7] ..... A47K 1/08

(52) U.S. Cl. ..... 248/312.1; 248/313; 248/215; 248/310; 248/318; 47/11

(58) Field of Search ..... 248/310, 318, 248/215, 312.1, 313; 24/455; 47/11

(56) References Cited

U.S. PATENT DOCUMENTS

| | | | | | |
|---|---|---|---|---|---|
| 1,334,199 | A | * | 3/1920 | Weiseman | 248/318 |
| 2,006,083 | A | * | 6/1935 | Dixon | 47/11 |
| 2,711,873 | A | * | 6/1955 | Larin | 248/215 |
| 2,764,384 | A | * | 9/1956 | Kirsch | 248/305 |
| 2,823,004 | A | * | 2/1958 | Melloh | 248/215 |
| 2,967,691 | A | * | 1/1961 | Lehnbeuter et al. | 248/312.1 |
| 3,155,360 | A | * | 11/1964 | Cassells | 248/313 |
| 3,193,234 | A | * | 7/1965 | Thurman et al. | 248/313 |
| 4,071,218 | A | * | 1/1978 | Pecka et al. | 248/312.1 |
| 4,440,371 | A | * | 4/1984 | Wijsman | 248/318 |
| 4,825,590 | A | | 5/1989 | Cullinane | |
| 5,074,504 | A | | 12/1991 | Minnick | |
| 5,329,728 | A | | 7/1994 | Ray | |

FOREIGN PATENT DOCUMENTS

| | | |
|---|---|---|
| AU | 90312/82 | 5/1983 |
| AU | 24842/97 | 1/1998 |
| DE | 42 23 052 | 2/1993 |
| DE | 197 11 106 | 10/1997 |
| EP | 0 047 025 | 3/1982 |
| FR | 2 617 030 | 12/1988 |
| GB | 2 241 876 | 9/1991 |

* cited by examiner

*Primary Examiner*—Kimberly Wood
(74) *Attorney, Agent, or Firm*—Knobbe, Martens, Olson & Bear, LLP

(57) ABSTRACT

The present invention provides a suspending device for a plant container having a base an upstanding parametric wall projecting from the base, the parametric wall having an outwardly projecting peripheral rim. The suspending device includes a wall receiving portion for receiving and releasably retaining a portion of the upper edge of the wall of the plant container, and a structure-securing portion for allowing the device and the plant container to be secured to a structure. The wall receiving portion may include a shoulder for abutting at least a portion of the peripheral rim. The wall receiving portion may also include a resilient member for maintaining said portion of the peripheral rim in abutting engagement with the shoulder such that the container is retained thereby; wherein, in use, the shoulder is capable of holding the full weight of the container to thereby suspend the container.

9 Claims, 4 Drawing Sheets

SUSPENDING DEVICE FOR A PLANT CONTAINER

This application is a 371 of PCT AU99/00038 Jan. 11, 1999.

FIELD OF THE INVENTION

The present invention relates to a suspending device for a plant container, and in particular relates to a device for use in suspending plant containers such as pot-plants from a wall, a trellis or a fence and the like.

BACKGROUND OF THE INVENTION

Plants have for many years been potted in various types and shapes of containers for ornamental use either indoors or outdoors. Invariably the containers are pots placed on a porch, patio or verandah, or on benches, tables and the like. Alternatively, some pots are suspended off the ground from tree branches, pergolahs or other support structures by way of wire, string or chain. Such pots are generally referred to as hanging baskets or hanging pots.

There have been no successful attempts to develop a system for easily suspending such containers from walls or fences. Most failed attempts have been unable to support the weight of the pot (with plant), or have only been able to support the pot such that it is inclined off vertical. In this respect, it will be appreciated that the inclination presents watering difficulties due to the immediate water run-off that occurs on watering.

Additionally, most attempts to support such containers from a wall or the like have resulted in large and cumbersome bracket systems. When such brackets are usually for use with flowers and plants that are being suspended to improve the aesthetics of an area, large and cumbersome brackets defeat the purpose of the flowers and plants.

It is an aim of the present invention to provide a suspending device for a plant container that is capable of being used to suspend a pot or the like from a fence, wall or trellis.

SUMMARY OF THE PRESENT INVENTION

The present invention provides a suspending device for a plant container, the plant container having a base and an upstanding perimetric wall projecting from the base, the perimetric wall having an outwardly projecting peripheral rim about its open upper edge, the suspending device including:

- a substantially U-shaped body, inverted in use such that it opens downwardly, the body having two limbs between which a portion of the upper edge of the wall of the plant container may be received and releasably retained;
- one limb defining a structure-securing portion for securing the device to a generally vertical structure, and providing a shoulder in the form of an inwardly and upwardly extending tongue on its inner surface;
- the other limb being resilient to urge the upper edge of the wall of the plant container against the shoulder;

wherein the underside of at least a portion of the peripheral rim of the plant container abuts against and rests upon the upwardly and inwardly extending tongue, which is capable of holding the full weight of the container (with plant) to thereby suspend the container.

In relation to the peripheral rim, it is to be appreciated that the reference to a 'rim' is to include reference to other similar structures about the upper edge of a plaint container, such as may sometimes be referred to as a collar, a lip, or a flange.

The shoulder may be in the form of an outcrop forming a ledge or projection extending away from the inner surface of the limb, the outcrop preferably being configured such that the underside of at least a portion of the peripheral rim of a container will abut and rest thereon when the upper edge of the wall is within the opening of the substantially U-shaped body.

In order to maintain the peripheral rim of the container in this abutting relationship with the outcrop, the other limb (the resilient member) of the substantially U-shaped body is preferably inclined towards the outcrop (restricting the size of the opening the substantially U-shaped body). In this way, and when the other limb is resiliently biased towards that position, the upper edge of the wall of the container will urge the two limbs apart when it is forced into the opening, and the resilience of the other limb will serve to hold the upper edge of the wall against the outcrop. The rim is thus held in abutting relationship with the outcrop by the action of the resilient limb of the substantially U-shaped body.

It will be appreciated that the shoulder of the device need not be in the form of an outcrop or ledge. Indeed, in one preferred form, it is envisaged that the shoulder will be provided by a projection, such as a tongue, projecting upwardly (and slightly inwardly) from the lower end of the inner surface of the limb. The tongue preferably tapers upwardly to provide a narrow abutting edge at its free end. In this form, the tongue may additionally be somewhat resilient to assist in the abutting engagement with the rim of the container.

In this respect, the narrow abutting edge of the tongue may be preferred for use with containers whose rims are rolled (or circular in cross-section) as the narrow edge can become locked into the recess between the rolled rim and the wall of the plant container. Indeed, it is envisaged that the suspending device of the present invention may be used in conjunction with a range of plant containers specifically manufactured to have such rolled rims or the like.

In the preferred form of the present invention, the device may additionally include a container leveling means in order to ensure that the containers can be suspended with their longitudinal axes substantially vertical. The container leveling means may be provided by extending the limb of the U-shaped body which provides the structure-securing portion (namely, that part of the device that will be secured to a wall, fence, trellis, or post and the like), beyond the length of the other limb. The extended limb may be tapered such that it widens as it extends downwardly. In this form, the taper may be of a size that corresponds to the taper of the wall of the container to be suspended, such that the extended limb maintains the wall of the container a suitable distance away from the structure on which the container is suspended. This will assist in maintaining the base of the container substantially horizontal and the longitudinal axis of the container substantially vertical.

It should also be appreciated that the structure-securing portion of the suspending device of the present invention may be provided in any suitable configuration, depending usually upon the nature of the structure the container is to be suspended from. For instance, in the form described above, the limb of the U-shaped body that defines the structure-securing portion may merely be provided with an aperture through which a securing bolt may be used. Alternatively, an additional limb may be provided (making the body a substantially W-shaped body, inverted in use), the additional limb creating a second opening that may receive a structure, or a part of a structure, therein. This alternative is envisaged to be particularly useful where the device is for use with a trellis or the like, where one of the horizontal stays of the trellis may be received in the second opening to secure the suspending device thereto.

It will thus be seen that the suspending device of the present invention may be provided as a simple one piece device, preferably moulded from a strong, semi-rigid plastic, that is relatively small in relation to the size of the containers that it will be suspending. Indeed, the device will most likely not be discernible in use over the upper edge of the wall of the container. Further, a range of appropriately configured suspending devices may be manufactured for sale with particular types of containers, and for use on different types of structures (and thus having different types of structure receiving portions).

Further still, the suspending device of the present invention may be used with any configuration of plant container, such as with plastic, ceramic or terracotta pots, whether they are round, square or rectangular, and of any size. The suspending device of the present invention merely needs to be manufactured in a size to suit the walls and rims of these pots. In this respect, various aspects of the configuration of the suspending device may need to be altered accordingly, but those alterations are considered to be within the scope of understanding of a skilled addressee. For instance, the size and resilience of the limbs may need to be altered, as may the size of the opening and of the shoulder.

BRIEF DESCRIPTION OF THE DRAWINGS

The present invention will now be described in relation to two preferred embodiments illustrated in the accompanying drawings. However, it must be appreciated that the following description is not to limit the generality of the above description.

In the drawings.

DETAILED DESCRIPTION OF THE DRAWINGS

Figure 1:
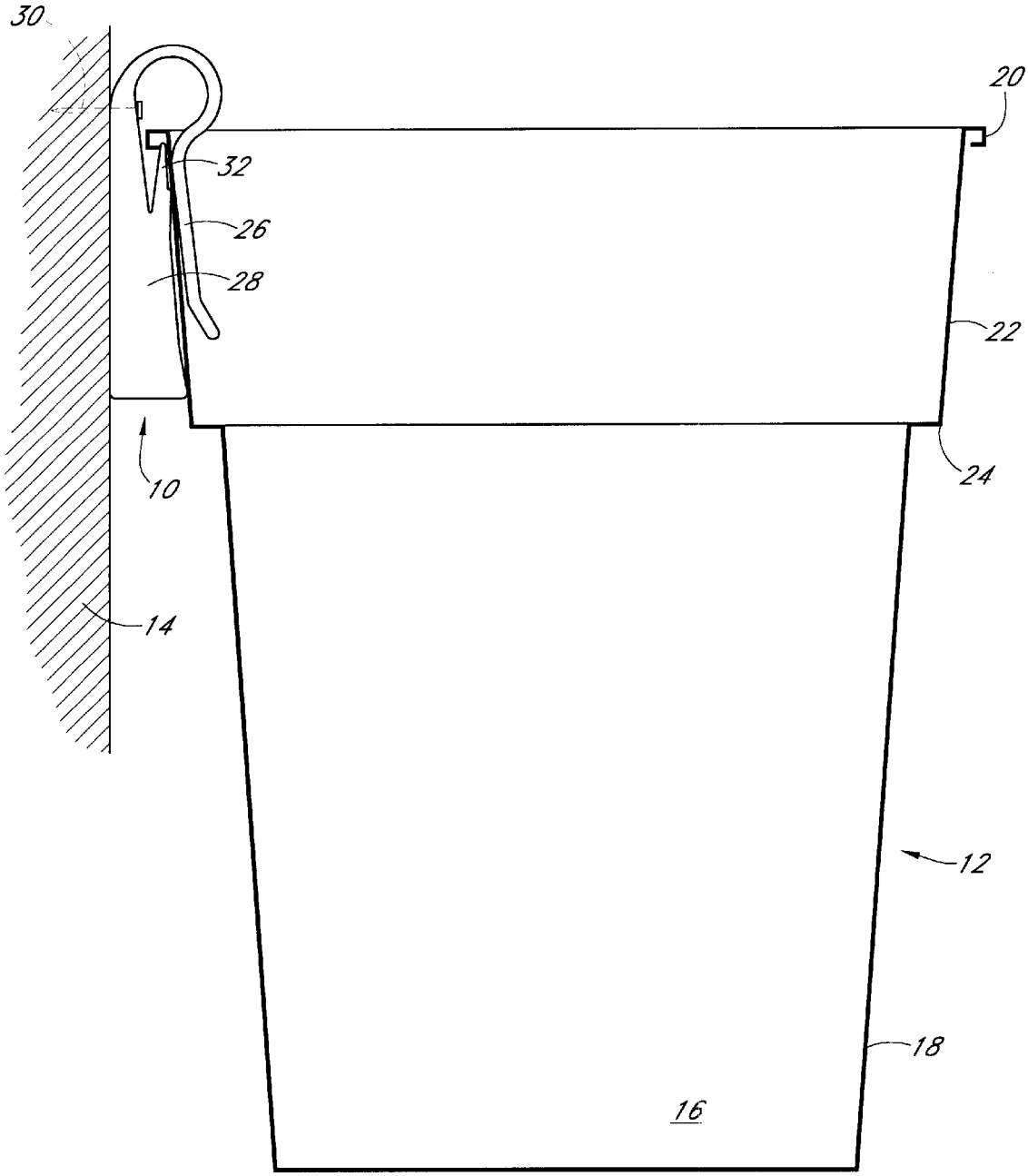
FIG. 1 is a side view of a suspending device, in use, in accordance with a first preferred embodiment of the present invention.

Illustrated in FIG. 1 is a suspending device 10 in accordance with a first preferred embodiment of the present invention, in use, suspending a plant container 12 from a structure 14, here illustrated as a vertical wall. The plant container 12 has a base 16 and an upstanding perimetric wall 18. The wall 18 includes an outwardly projecting peripheral rim 20 about its open upper edge 22. The container 12 illustrated in FIG. 1 additionally includes an expanded portion 24 which is in the form of a collar.

The suspending device 10 in this embodiment is in a substantially U-shaped form, and is inverted in use. In this form, there is provided a device 10 that has two downwardly extending limbs 26 and 28 respectively. The limb 28 in this form provides the structure-securing portion of the suspending device 10. This is evident by the presence of an aperture through which a screw or nail 30 may be placed to secure the device 10 to the structure 14 (shown as a vertical wall in FIG. 1).

The suspending device 10 also includes a container wall receiving portion which in this embodiment is provided by the interaction of the two limbs 26 and 28, together with the opening created therebetween. This container wall receiving portion includes a shoulder which in this form is provided as an upwardly and inwardly extending tongue 32 on the inner surface of limb 28, the shoulder being configured so as to abut at least a portion of the peripheral rim 20 of the container 12. The limb 26 is thus the resilient member referred to above in the general description of the invention, and this limb 26 serves to urge the upper region 22 of the wall 18 against the tongue 32 such that the tongue 32 is maintained in abutting relationship therewith. The tongue 32 thus carries the load of the container.

The interaction of the resilient limb 26 with tongue 32 thus serves to maintain the container suspended from the vertical wall 14. The resilience of the limb 26 allows the container to be easily removed from its suspended position (possibly for maintenance, re-potting or the like), and then easily replaced in position.

As will also be apparent from the embodiment of FIG. 1, the limb of the suspending device 10 may be provided as a generally wedge shaped limb which assists in maintaining the container 12 in a vertical alignment.

Figure 2:
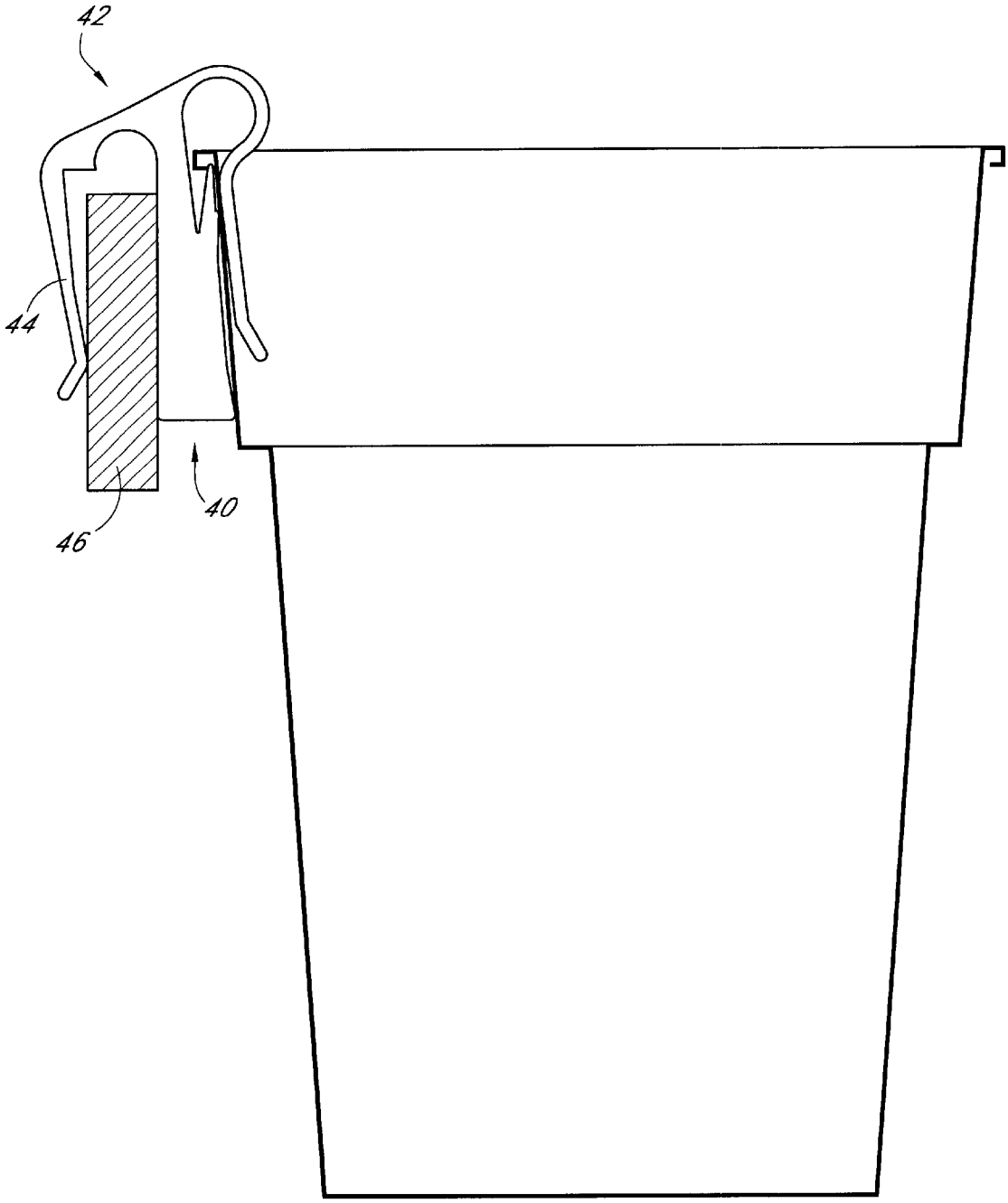
FIG. 2 is a side view of a suspending device, in use, in accordance with a second preferred embodiment of the present invention.

FIG. 2 illustrates an alternative embodiment for a suspending device 40 that includes an alternative structure-securing portion 42. The alternative structure-securing portion 42 includes an additional limb 44, again being a resilient limb, which is capable of fitting over and clamping to a fencing pail 46 or the like. In all other respects, the operation of this alternative suspending device 42 is similar to the suspending device 10 illustrated in FIG. 1.

Figure 3:
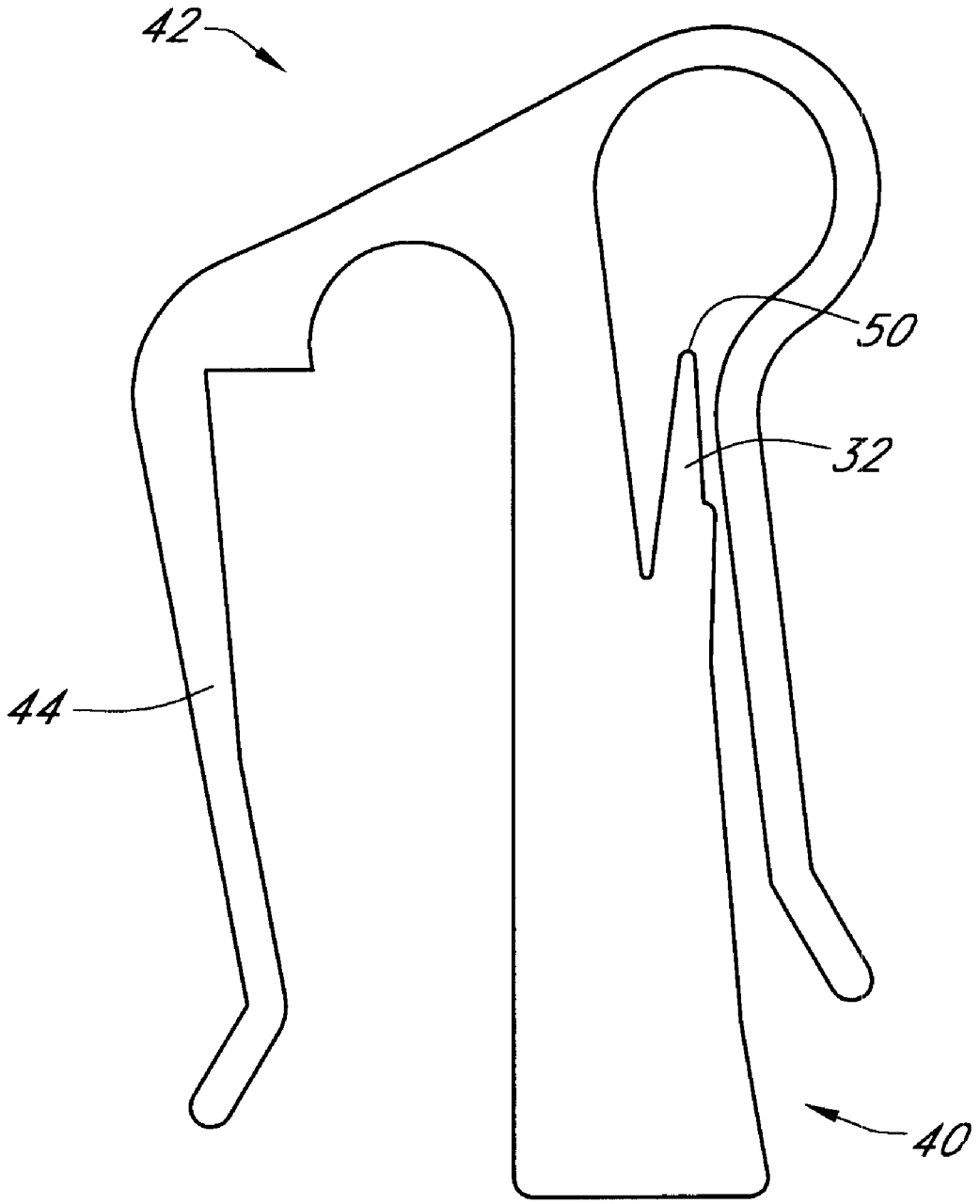
FIG. 3 is an exploded side view of the suspending device illustrated in FIG. 2.

FIG. 3 illustrates the suspending device 40 in greater detail. From this figure, the arrangement of the limbs (26 and 28 in FIG. 1) and the configuration of the shoulder (tongue 32 in FIG. 1) are quite clear. As can be seen, the tongue (32) is slightly tapered towards its free end 50 to assist in providing a secure abutment with the peripheral rim of a plant container.

Figure 4A:
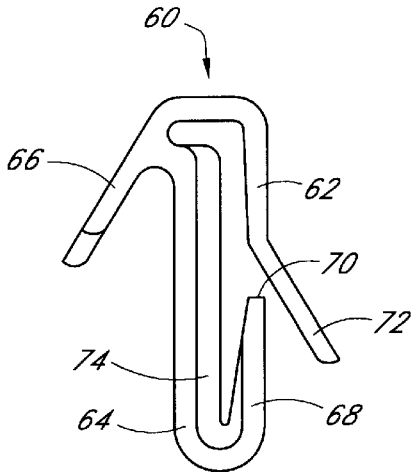
FIGS. 4*a* and 4*b* are side and rear views of a suspending device in accordance with a third preferred embodiment.
Figure 4B:
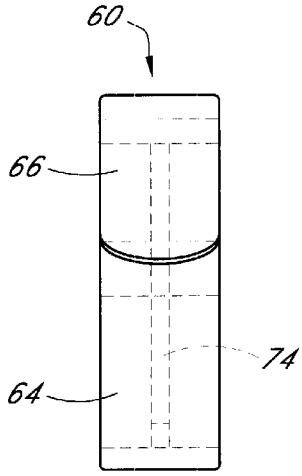

FIGS. 4*a* and 4*b* illustrate a further embodiment of a suspending device according to the present invention. The suspending device 60 is of the generally w-shaped form, inverted in use, having three downwardly projecting limbs 62, 64 and 66.

In this form of the invention, the limbs 64 and 66 together form the structure-securing portion of the device 60, limb 66 being capable of being hung on a suitable structure. Then, limbs 62 and 64 together form the container wall receiving portion of the device.

The container wall receiving portion includes a shoulder in the form of an upwardly extending tongue 68, configured so as to abut at least a portion of the peripheral rim of the container. The limb 62 is thus the resilient member referred to above, which serves to urge the upper region of the wall of a container against the tongue 68, maintaining the free end 70 of the tongue 68 in abutting engagement with the rim.

As is also illustrated, the limb 62 of the suspending device 60 includes an inclined portion 72 at its free end that assists in allowing easy capture of the upper region of the wall of a container thereby. Also illustrated is a strengthening web 74 provided longitudinally and centrally along the inside of limb 64. This web 74 provides extra strength and stability for the device in use.

Figure 5A:
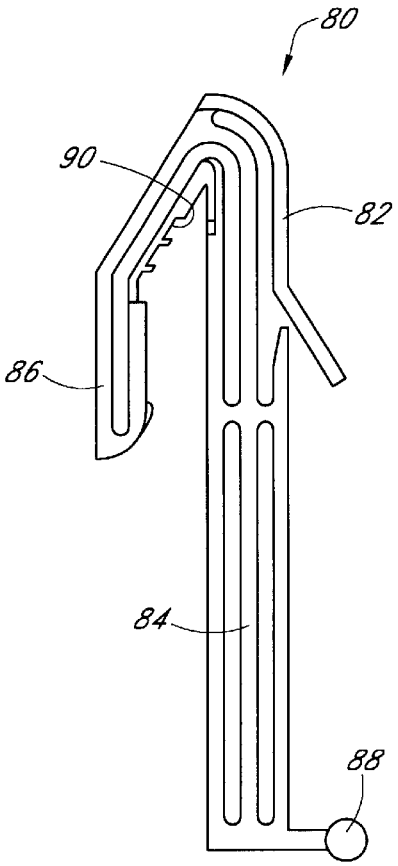
FIGS. 5*a* and 5*b* are side and rear views of a suspending device in accordance with a fourth preferred embodiment.
Figure 5B:
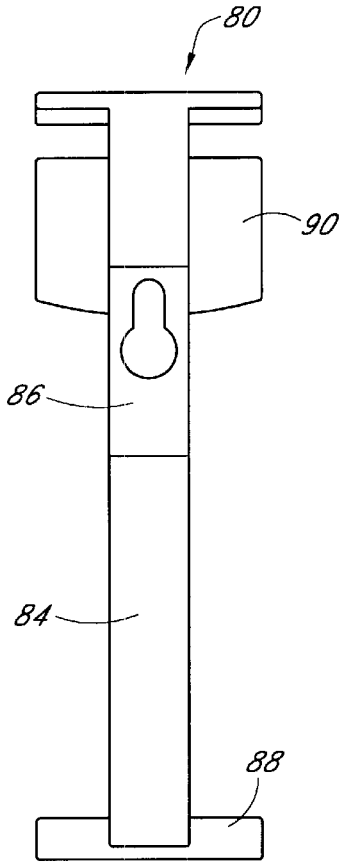

FIGS. 5*a* and 5*b* illustrate yet a further embodiment of a suspending device according to the present invention. The suspending device 80 is again of the generally w-shaped form, inverted in use, and having three downwardly projecting limbs 82, 84 and 86.

Compared to the embodiment of FIGS. 4*a* and 4*b,* the device 80 has a slightly more elongate limb 86, and the central limb 84 is substantially more elongate, also having an alignment toe 88 at its free end. The alignment toe 88 assists in maintaining some pots in their preferred vertical alignment by providing an abutment to rest against the inclined wall of a container. Of course, the alignment toe 88 may be provided in any length as desired.

Also apparent from FIG. 5*b* is the provision of a stabilising flange 90 of a width larger than the width of the device 80 itself.

From the embodiments described above it will be apparent that the suspending device of the present invention is a simple and easy to use device that may be useful in many situations. The inventive concepts allow for a device to be adapted to suit a variety of containers and support situations, whilst being comprised of a minimum of parts.

Finally, it should be appreciated that there may be other variations and modifications made to the configurations described herein that are also within the scope of the present invention.

What is claimed is:

1. A suspending plant container assembly comprising:

a plant container having a base and an upstanding parametric wall projecting from the base, the parametric wall having an outwardly projecting peripheral rim about its open upper edge that projects outwardly from the parametric wall a first distance;

a body, inverted in use such that it opens downwardly, the body having two limbs and an interconnecting portion interconnecting the two limbs wherein a portion of the upper edge of the parametric wall of the plant container may be received and releasably retained in the space between the two limbs and the interconnecting portion;

one limb including a structure-securing portion for securing the device to a generally vertical structure, and a shoulder in the form of an inwardly and upwardly extending tongue located on an inner surface of said one limb, and said tongue and structure-securing portion being connected by a joining portion of said one limb;

the other limb being resilient to urge the upper edge of the parametric wall of the plant container against a portion of the shoulder;

wherein, when the plant container is suspended by the device, the underside of at least a portion of the peripheral rim of the plant container rests upon the upwardly and inwardly extending tongue, and the peripheral rim of the plant container does not contact the joining portion of said one limb so that the tongue provides the hanging support for the full weight of the plant container and locates the plant container in the desired orientation and wherein the one limb and the other limb are spaced apart from each other in the plane of the outwardly projecting peripheral rim such that the outwardly projecting peripheral rim is spaced from the one limb and the interconnecting portion interconnecting the one limb and the other limb.

2. The suspending plant container assembly of claim 1, wherein the other limb is inclined towards the one limb, restricting the size of the opening of the body, the other limb being resiliently biased toward that position.

3. The suspending plant container assembly of claim 1, wherein the tongue tapers upwardly to provide a narrow abutting edge at its free end.

4. The suspending plant container assembly of claim 1, wherein the tongue is resilient to assist in the abutting engagement with the peripheral rim.

5. The suspending plant container assembly of claim 1, wherein the device includes a container leveling means in order to ensure that the plant container can be suspended with its longitudinal axis substantially vertical.

6. The suspending plant container assembly of claim 5, wherein the container leveling means is provided by extending the one limb beyond the length of the other limb.

7. The suspending plant container assembly of claim 6, wherein the extended limb is tapered such that it widens as it extends downwardly.

8. The suspending plant container assembly of claim 7, wherein an additional limb is provided adjacent the one limb, the additional limb creating a second opening that may receive a structure or part of a structure therein, the body of the suspending assembly then being substantially W-shaped.

9. The suspending plant container assembly of claim 1, wherein an additional limb is provided adjacent the one limb, the additional limb creating a second opening that may receive a structure, or part of a structure therein, the body of the suspending assembly then being substantially W-shaped.

* * * * *

UNITED STATES PATENT AND TRADEMARK OFFICE

CERTIFICATE OF CORRECTION

PATENT NO. : 6,588,721 B1
DATED : July 8, 2003
INVENTOR(S) : Guy R. Rischmueller It is certified that error appears in the above-identified patent and that said Letters Patent is hereby corrected as shown below:

Title page,
Item [73], please add:
-- [73] Assignee: DNR Group Pty. Ltd, South Australia, Australia --

Signed and Sealed this

Twenty-second Day of June, 2004

JON W. DUDAS
*Acting Director of the United States Patent and Trademark Office*